US006401404B1

(12) United States Patent
Fillipp et al.

(10) Patent No.: US 6,401,404 B1
(45) Date of Patent: Jun. 11, 2002

(54) EXPANDABLE SPHERE

(75) Inventors: Stephen L. Fillipp; Chad H. Jones, both of Lubbock, TX (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/779,720

(22) Filed: Feb. 8, 2001

(51) Int. Cl.[7] ..... E04B 1/346; E04B 7/16

(52) U.S. Cl. ..... 52/80.1; 52/80.1; 52/646; 362/252; 362/249; 40/538

(58) Field of Search ..... 52/64, 72, 80.1, 52/81.2, 81.3, 645, 646; 446/108, 109, 111, 124, 128; 40/538, 539

(56) References Cited

U.S. PATENT DOCUMENTS 4,450,851 A * 5/1984 Beavers
5,629,057 A 5/1997 Wang et al.
5,645,343 A 7/1997 Rinehimer
5,876,111 A 3/1999 Wu
6,070,991 A 6/2000 Rumpel
6,135,617 A 10/2000 Lai

* cited by examiner

*Primary Examiner*—Carl D. Friedman
*Assistant Examiner*—Kevin McDermott
(74) *Attorney, Agent, or Firm*—Calfee, Halter & Griswold LLP

(57) ABSTRACT

A decorative, spherically shaped structure formed by a plurality of circumferentially spaced, elongated, pivotably interconnected ribs that lie in substantially coplanar, contiguous relation to each other when not expanded, but are readily expandable to form a discontinuous, substantially spherical body having top and bottom hub sections formed by end panels unitarily molded onto the ends of each rib. The pivotable interconnection between adjacent ribs is achieved by providing tabs on the end panels, the tabs having cylindrical apertures cooperatively alignable with mating tabs of adjacent ribs, permitting such cooperatively aligned tabs to be pinned or riveted together to form an integral structure. The end panels of each molded rib preferably further comprise cooperatively engageable lips having stepped cross-sections that intermesh to form substantially continuous upper and lower hub surfaces providing strength and rigidity to the expanded sphere.

8 Claims, 6 Drawing Sheets

EXPANDABLE SPHERE

BACKGROUND OF THE INVENTION

1. Field of the Invention

This invention relates to decorative bodies having generally spherical shapes defined by arcuately spaced ribs made of moldable thermoplastic resins. More particularly, the invention relates to an expandable structure that can be packaged and shipped in a substantially flat orientation, and then quickly and conveniently expanded by the user to produce a spherically shaped body.

2. Description of Related Art

Decorative spheres having a plurality of circumferentially spaced arcuate ribs are well known, having been disclosed, for example, in U.S. Pat. No. 5,645,343. Such spheres can be used as a support structure for the display of decorative lights linked together in light strings that are also well known in the art. A disadvantage of the spheres disclosed in U.S. Pat. No. 5,645,343 is that they comprise many different parts that must be assembled by the user because of the economic disadvantages associated with shipping the relatively voluminous assembled spheres. The structures disclosed in U.S. Pat. No. 5,645,343 also have the disadvantage of unattractive, vertically disposed ribs inside the sphere that contribute to the material cost and weight of the finished product.

Other decorative structures useful for displaying lights in a spherical array are disclosed, for example, in U.S. Pat. Nos. 5,629,057; 6,70,991 and 6,135,617.

SUMMARY OF THE INVENTION

The invention disclosed herein is a spherically shaped structure preferably comprising a plurality of substantially identical, pivotably interconnected, elongate ribs that lie in substantially coplanar, contiguous relation to each other when folded, but are readily expandable to form a discontinuous, substantially spherical body having a plurality of circumferentially spaced ribs and top and bottom hub sections formed by end panels unitarily molded onto the ends of each rib. Each sphere will desirably comprise at least four, and preferably at least six or eight, ribs. Generally speaking, larger diameter spheres will preferably comprise a greater number of ribs than smaller diameter spheres. The pivotable interconnection between adjacent ribs is preferably achieved by providing tabs on the end panels, the tabs being cooperatively alignable with mating tabs of adjacent ribs, permitting such cooperatively aligned tabs to be pivotably connected to form an integral structure. The end panels of each molded rib preferably further comprise cooperatively engageable first and second edges having stepped cross-sections that, when engaged, form substantially continuous upper and lower hub surfaces providing strength and rigidity to the expanded sphere. Once the sphere is expanded, a pin or other similarly effective, releasable locking element is desirably used to interconnect the last two cooperatively aligned tabs of each of the top and bottom hub surfaces.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
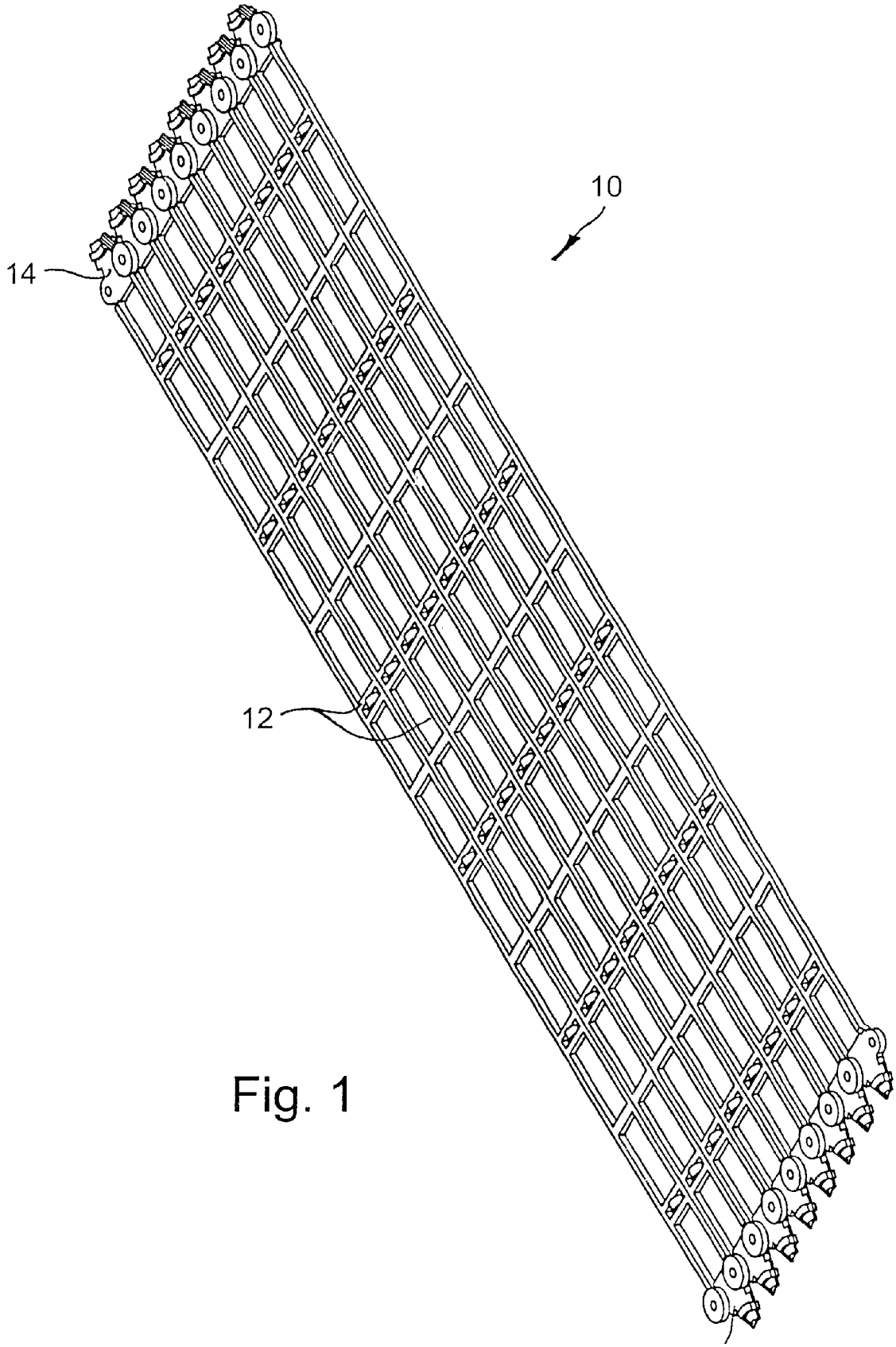
FIG. 1 is a top perspective view showing a preferred expandable sphere of the invention in its unexpanded position.

Referring to FIG. 1, expandable structure 10 of the invention preferably comprises a plurality of substantially identical, elongated, interconnected, flexible, molded plastic ribs 12, each rib having an intermediate section and two ends 14, 16. In the position shown in FIG. 1, ribs 12 are disposed in side-by-side, substantially flat relation and ends 14, 16 of adjacent ribs 12 are pivotably connected. When expandable structure 10 is disposed in this position, it is easily packaged, shipped and stored.

Figure 2:
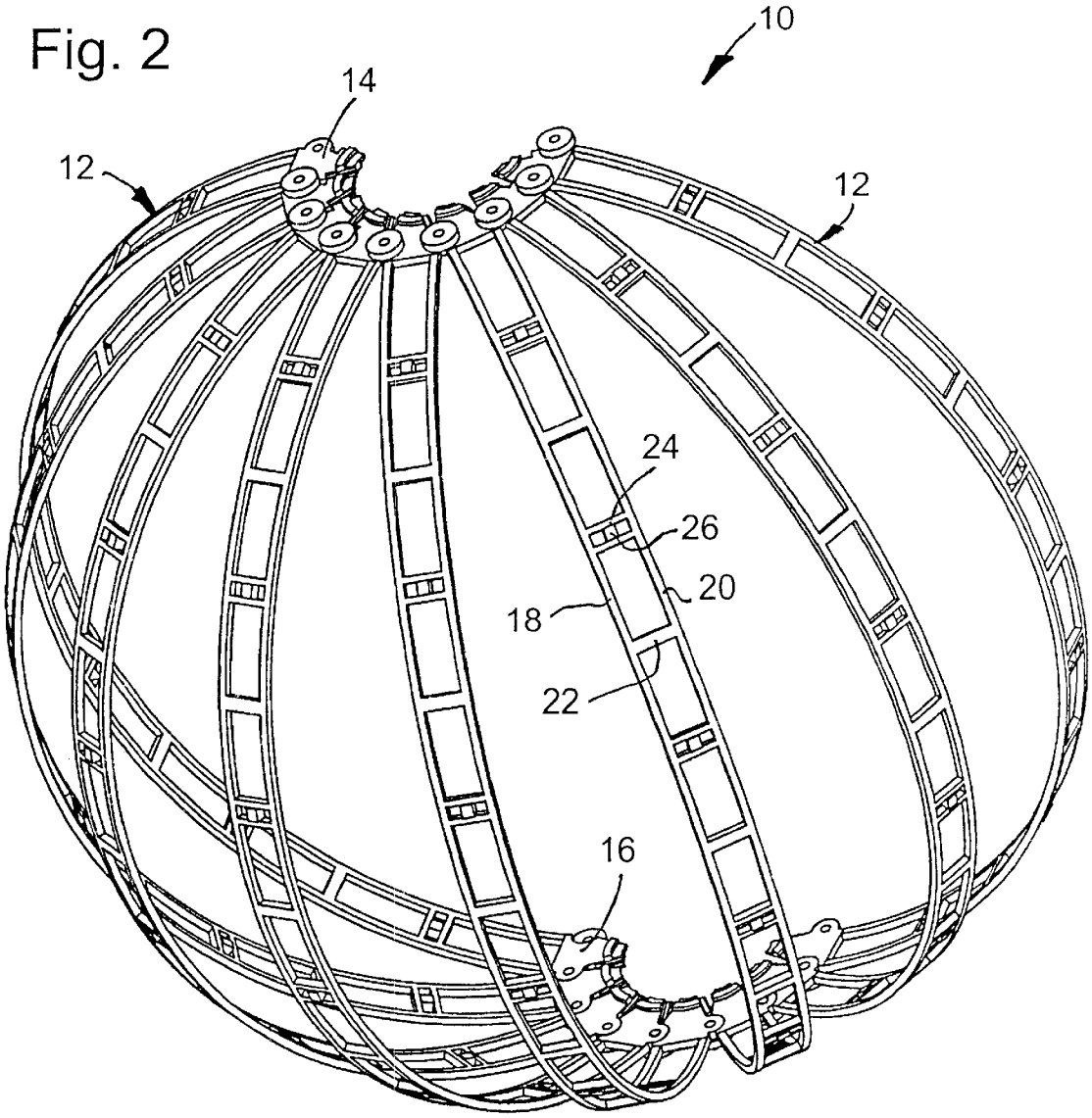
FIG. 2 is a top perspective view of the expandable sphere of FIG. 1 with its ribs partially expanded.
Figure 3:
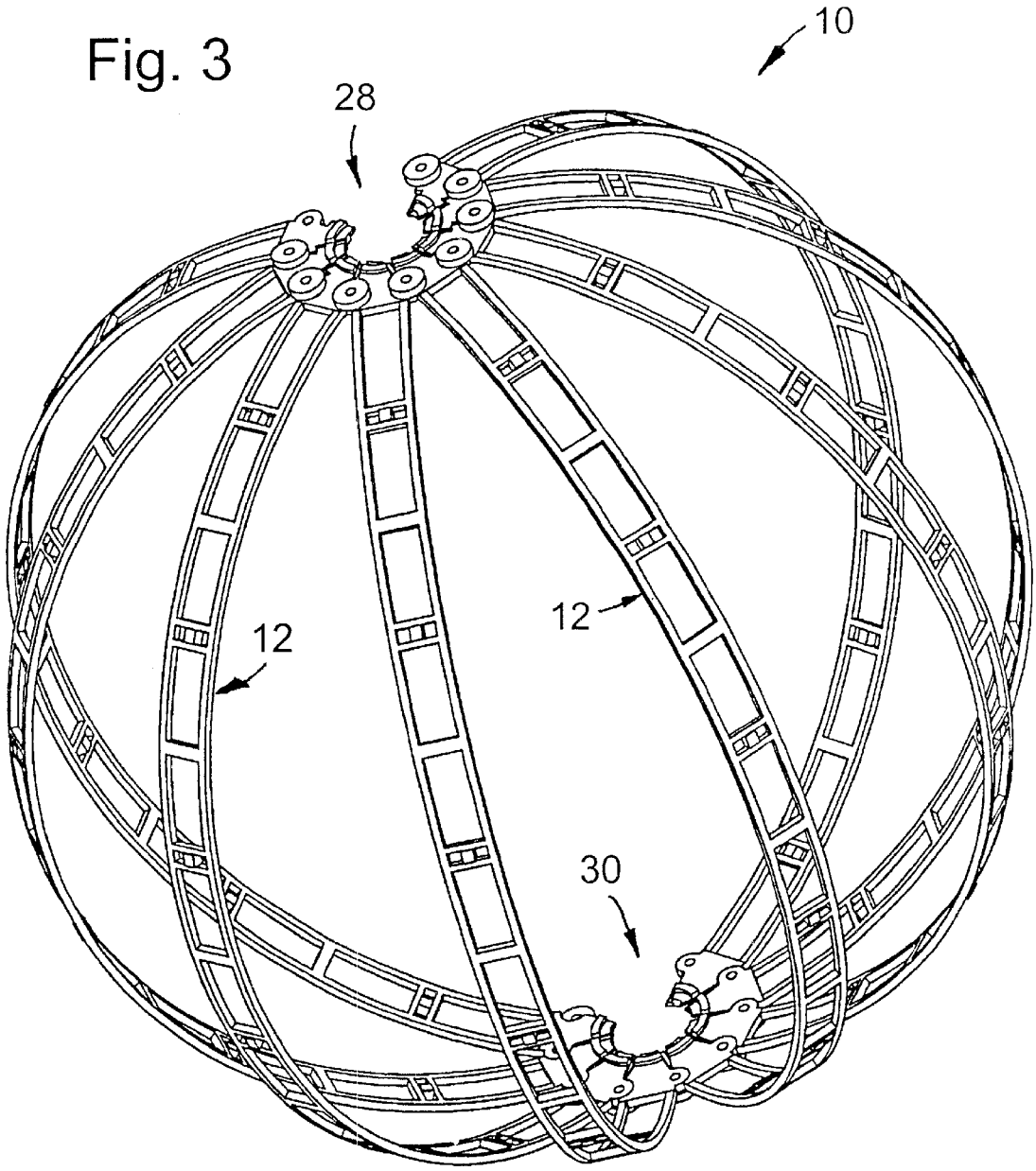
FIG. 3 is a top perspective view of the expandable sphere of FIG. 1 with its ribs further expanded from the position shown in FIG. 2.

Referring to FIGS. 2–3, expandable structure 10 can be expanded by pivoting ends 14, 16 relative to each other, thereby causing ribs 12 to flex and spread apart circumferentially. Each rib 12 preferably comprises at least two longitudinally extending members 18, 20 and at least two transverse members 22, 24 joining the two longitudinal members 18, 20. If desired, transverse members 24 can also be used to support decorative light mounting structures 26, which can be employed in the attachment of decorative bulb and socket assemblies (not shown) to expandable structure 10 for ornamental display purposes. Light mounting structures 26 are shown diagrammatically in the drawings because of the great number of well-known light attachment means that can be utilized to support decorative light strings on expandable structure 10. In FIG. 2, ribs 12 are positioned approximately halfway between the unexpanded and expanded positions. In FIG. 3, ribs 12 are positioned between the position of FIG. 2 and the fully expanded position.

Figure 4:
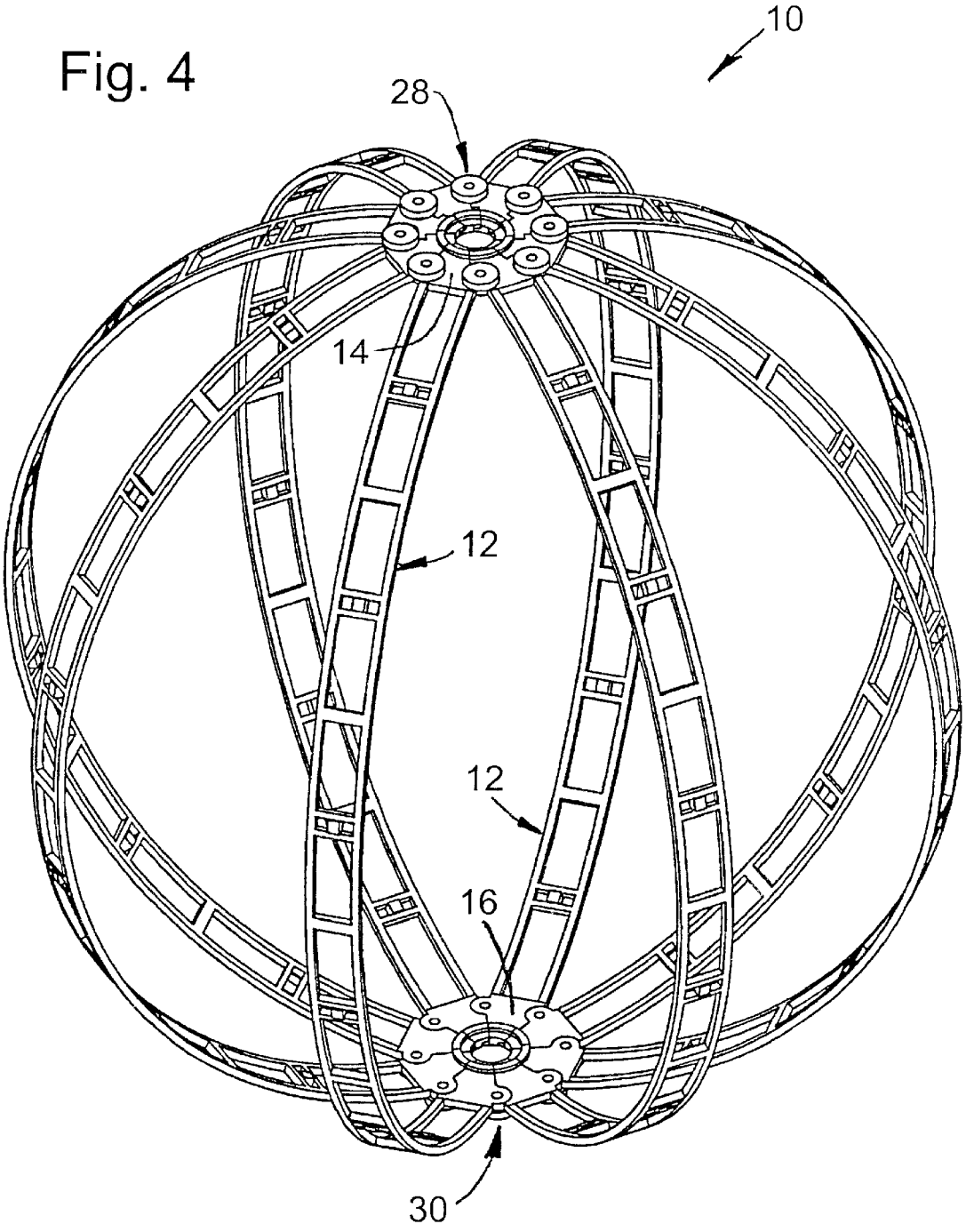
FIG. 4 is a top perspective view of the expandable sphere of FIG. 1 in the fully expanded position.
Figure 5:
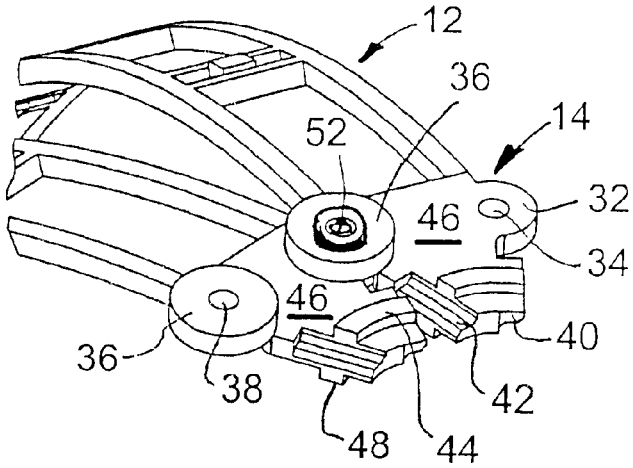
FIG. 5 is an enlarged detail top perspective view depicting the end panels and tabs at one end of two adjacent ribs in a partially separated position.
Figure 6:
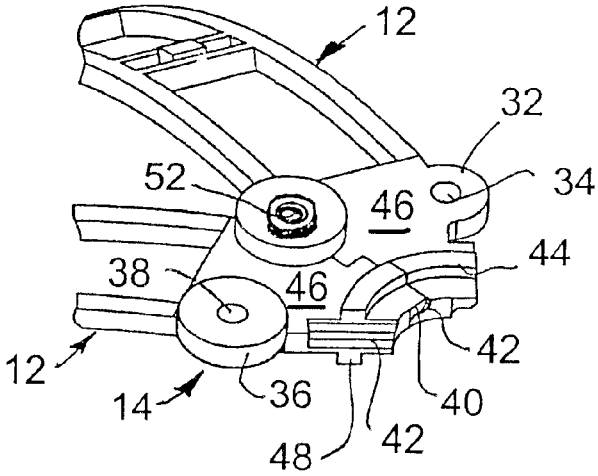
FIG. 6 is an enlarged detail top perspective view depicting the structures of FIG. 5 wherein the end panels and tabs of the two adjacent ribs are pivoted into their fully engaged position.

Referring to FIG. 4, ribs 12 are depicted in the fully expanded position, with the ends 14, 16 of each rib 12 cooperatively engaged with the ends 14, 16 of the adjacent ribs to form upper and lower hubs 28, 30, respectively, of expandable sphere 10. As used herein, the terms "sphere" and "spherical" are used to refer to a three dimensional object having spaced-apart ribs that, if encircled in all directions by a continuous web, would define a substantially spherical surface. It should be understood that the number of ribs 12 in each expandable sphere 10 of the invention can vary, although at least four ribs are preferred for establishing the spherical form, and at least six or eight ribs 12 are particularly preferred. Depending upon the size of expandable sphere 10, even more ribs 12 may be desirable, with a greater number of ribs being generally preferred for expandable spheres 10 having progressively greater diameters. It should also be understood that the structural configuration of each rib 12 can vary significantly from that shown in the drawings, provided that each rib 12 is preferably moldable from a polymeric resin and has sufficient flexibility and compliance in its molded state to permit each rib 12 to be flexed from a flat to an arcuate configuration as ribs 12 are separated to facilitate engagement of ends 14,16.

The structure of ends 14,16 is preferably substantially identical and is further described for illustrative purposes in relation to ends 14 shown in FIGS. 5–8. Each rib end 14 preferably comprises an end panel 46, most preferably unitarily molded onto the end of rib 12, with first and second projecting tabs 32, 36, with tab 32 of one rib 12 being cooperatively alignable with and pivotably connected to tab 36 of an adjacent rib. As shown in FIGS. 5–8, tabs 32, 36 are made in a generally arcuate or cylindrical shape, with cylindrical apertures 34, 38, respectively, that permit the convenient insertion during manufacture of pop rivets 52, or other similarly effective pin members or attachment means to pivotably connect the two cooperatively aligned tabs. As shown in the preferred embodiment, tab 32 slides beneath tab 36 in each instance where the two are brought into cooperative alignment as ribs 12 are fully separated. End panels 46 preferably further comprise first and second stepped edges 40, 42, which are cooperatively engageable with the second and first stepped edges 42, 40, respectively, of each adjacent rib 12 whenever expandable structure 10 is fully expanded. Arcuate reinforcing ridges 44, 48 are also preferably provided on the top and bottom surfaces, respectively, of end panels 46 to provide additional structural reinforcement to expandable structure 10.

Figure 7:
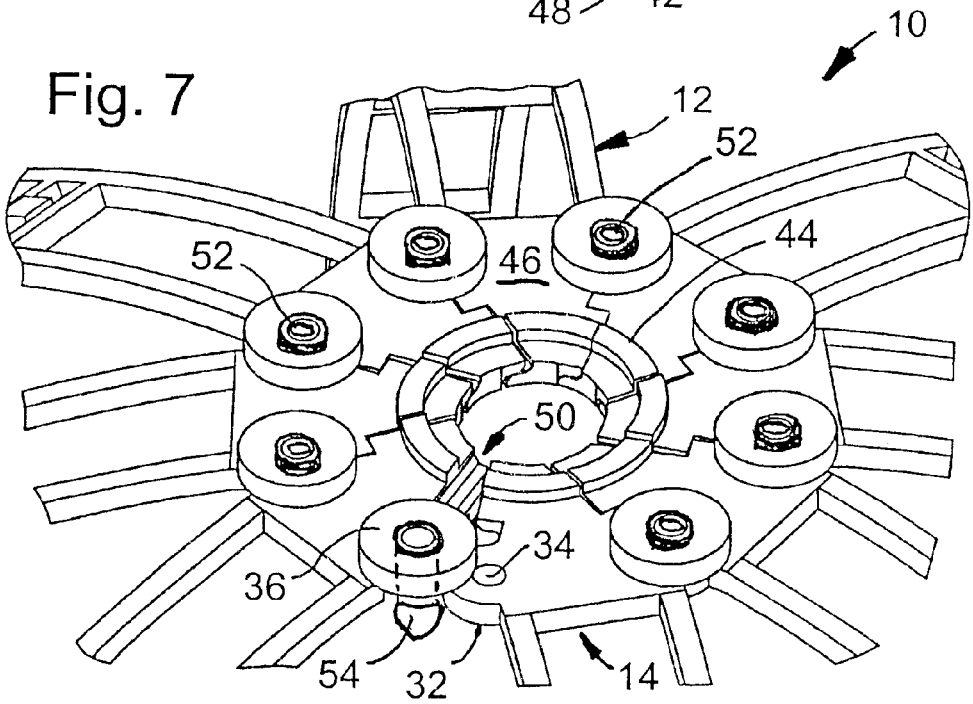
FIG. 7 is an enlarged detail top perspective view depicting the end structures of eight circumferentially spaced ribs when the sphere is almost completely expanded.
Figure 8:
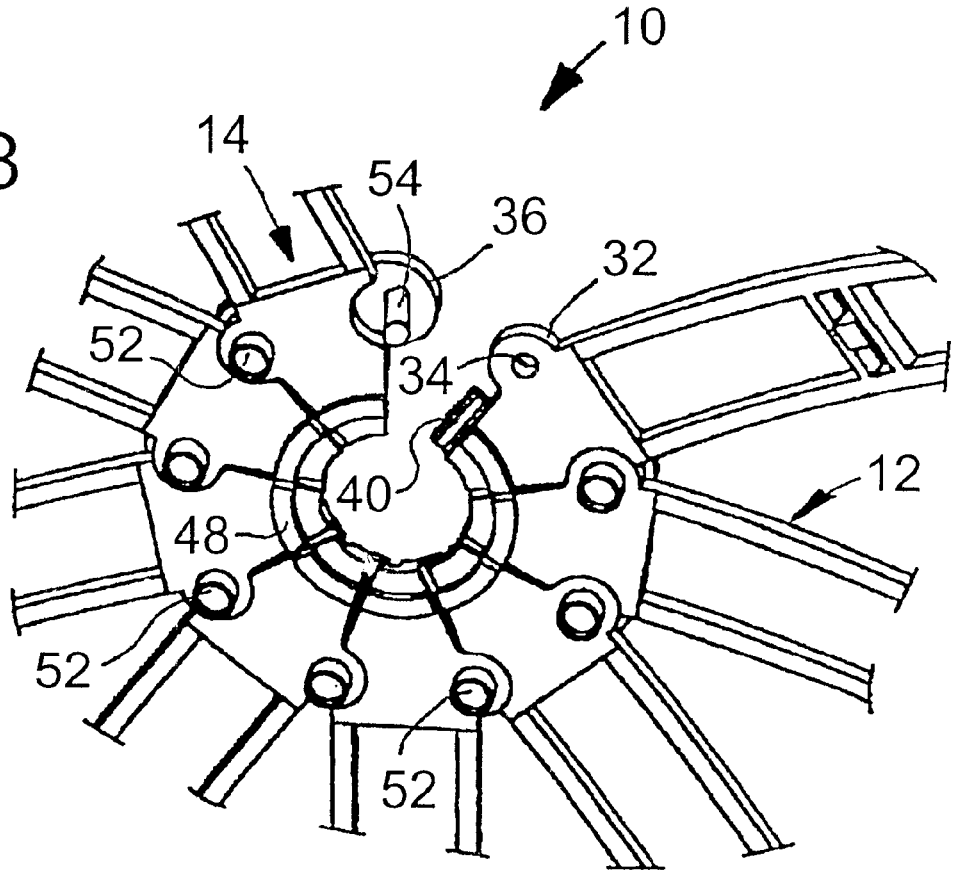
FIG. 8 is an enlarged detail perspective view of the top hub structure of the expandable sphere of FIG. 1 as viewed from inside the sphere when the ribs are almost fully expanded.

Referring to FIGS. 7 and 8, pop rivets 52 or other similarly effective means are preferably installed to interconnect adjacent ribs 12 during the manufacturing process. However, the two outermost ribs 12 from the flat array as previously described in relation to FIG. 1 will desirably each have one remaining available projecting tab at each end. According to one particularly preferred embodiment of the invention, as expandable sphere 10 is almost fully expanded, the last two available projecting tabs 32, 36 at each hub of the sphere approach a point where they also become cooperatively aligned. To facilitate convenient interconnection by the user, the available projecting tab 36 preferably comprises a projecting pin member 54 that can be inserted into releasable frictional engagement with aperture 34 of cooperatively aligned tab 32. The insertion of pin member 54 into aperture 34 by the user at each end of expandable sphere 10 releasably locks ribs 12 into their fully expanded position. Alternatively, it will be appreciated upon reading this disclosure that the last available projecting tab 36 can also be made with an aperture 38 provided that a separate locking member is provided for use in connecting tabs 32, 36 when they are cooperatively aligned following full expansion of ribs 12. Any such locking member is preferably releasable to permit the sphere to be returned to its flat position following use.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. An expandable structure comprising at least four substantially identical, elongated, interconnected, flexible, molded plastic ribs, each rib having an intermediate section and two ends, each rib end having a unitarily molded end panel with first and second projecting tabs, the first tab of one rib being cooperatively alignable with and pivotably connected to the second tab of an adjacent rib;

the interconnected ribs being selectively positionable into first and second positions, the first position wherein the ribs are disposed in a substantially flat, side-by-side array having a top, bottom and two sides, the outermost rib on each side of the flat array each having at least one available projecting tab at each end, and the second position wherein the intermediate sections of the ribs are pivoted away from each other in a spherical, circumferentially spaced array, thereby cooperatively aligning the available projecting tabs at each end of the outermost ribs; and releasable locking elements positionable so as to secure the cooperatively aligned available projecting tabs to each other.

2. The expandable structure of claim 1 wherein each end panel further comprises first and second stepped edges which are cooperatively engageable with the second and first stepped edges, respectively, of each adjacent rib whenever the structure is positioned in the second position.

3. The expandable structure of claim 1 comprising eight ribs.

4. The expandable structure of claim 1 wherein the first and second projecting tabs comprise alignable cylindrical apertures.

5. The expandable structure of claim 1 wherein adjacent ribs in the flat array are pivotably connected by pop rivets.

6. The expandable structure of claim 1 wherein one of the available projecting tabs on each end of the two outermost ribs comprises a molded projection that is frictionally engageable with the cooperatively aligned available projecting tab.

7. The expandable structure of claim 1 wherein each rib further comprises at least two substantially parallel longitudinal members.

8. The expandable structure of claim 7 wherein each rib further comprises at least two transverse members interconnecting the two longitudinal members at positions intermediate the two rib ends.

* * * * *